US006048825A

United States Patent [19]

Markson et al.

[11] Patent Number: 6,048,825

[45] Date of Patent: Apr. 11, 2000

[54] LUBRICANT COMPOSITION

[75] Inventors: Andrew J. Markson, Reading; John W. A. Pragnell, Pangbourne; Mark A. Edwards, Binfield, all of United Kingdom

[73] Assignee: Castrol Limited, United Kingdom

[21] Appl. No.: 09/261,965

[22] Filed: Mar. 3, 1999

Related U.S. Application Data

[63] Continuation of application No. 08/722,245, Dec. 9, 1996, abandoned.

[30] Foreign Application Priority Data

Apr. 26, 1994 [GB] United Kingdom ..... 9408235

[51] Int. Cl.[7] ..... C10M 133/44

[52] U.S. Cl. ..... 508/256; 508/278; 508/280; 508/421; 508/433; 508/485; 508/506; 508/508; 508/510; 508/518

[58] Field of Search ..... 508/256, 279, 508/280, 433, 506, 508, 510, 518, 421, 485

[56] References Cited

U.S. PATENT DOCUMENTS 3,483,122 12/1969 MacPhail ..... 508/433

FOREIGN PATENT DOCUMENTS 1287647 9/1972 United Kingdom .

*Primary Examiner*—Gabrielle Brouillette
*Assistant Examiner*—Cephia D. Toomer
*Attorney, Agent, or Firm*—Bacon & Thomas, PLLC

[57] ABSTRACT

A lubricant composition suitable as a helicopter transmission lubricant comprises a synthetic base stock of viscosity in the range 5.0 to 10.0 cSt at 100° C., an antioxidant component, a neutral organic phosphate component, a dicarboxylic acid component, a monocarboxylic acid component, a triazole component and a phosphorus containing extreme pressure additive.

13 Claims, No Drawings

LUBRICANT COMPOSITION

This application is a continuation of U.S. patent application Ser. No. 08/722,245 filed Dec. 9, 1996, now abandoned.

BACKGROUND OF THE INVENTION

1. Field of the Invention

This invention relates to a lubricant composition and is particularly concerned with a transmission lubricant suitable, for example, for helicopter transmission systems.

2. Description of Related Art

The development of new transmission systems, for example, for helicopters, has led to the requirement for dedicated lubricants for such purposes which can meet demanding load carrying and corrosion protection criteria. Specifications put forward by, for example, the U.K. Ministry of Defence and the United States Navy, pose requirements to be met by new dedicated helicopter transmission lubricants that cannot be fulfilled by existing aviation turbine engine lubricants. There is thus a need for the development of new and improved lubricant compositions for such purposes. The present invention seeks to fulfil this need.

DE-A-2039785 discloses a load carrying additive composition for a gas turbine engine. The load carrying additive composition comprises a synthetic ester base stock fluid having a viscosity of 5.6 to 6.0 cs. at 99° C. (210° F.) (see the examples).

U.S. Pat. No. 3,694,382 discloses a lubricant for a gas turbine engine. The lubricant comprises a synthetic ester base stock having a viscosity ranging from 4.0 to 9.1 cs. at 99° C. (210° F.).

FR-A-2215462 discloses a lubricant having a mineral oil as its base stock.

WO-A-9410270 discloses a corrosion inhibiting lubricating composition comprising a synthetic base stock having a viscosity of at least 4.9 cSt at 100° C.

SUMMARY OF THE INVENTION

Accordingly, the present invention provides a lubricant composition comprising:

a) a base component comprising one or more synthetic base stocks, which base component has a viscosity in the range of from 8.5 to 9.5 cSt at 100° C.;

b) at least one antioxidant selected from aromatic amines and hindered phenolics;

c) at least one neutral organic phosphate of the formula $(R^1O)_3PO$ where $R^1$ is a tolyl, phenyl, xylyl, alkyl or cycloalkyl group, the alkyl or cycloalkyl group having up to 10 carbon atoms;

d) at least one saturated and/or unsaturated dicarboxylic acid of the general formula

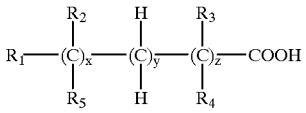

wherein x+y+z is an integer in the range from 2 to 22 inclusive and where at least one of the groups $R_1$ to $R_5$ is a carboxylic acid group and the remaining groups $R_1$ to $R_5$ are selected from alkyl, hydroxy, nitro, amino, carboxyl, hydrogen or alkyl derivatives thereof, where alkyl is a short chain of up to 5 carbon atoms; and/or a dicarboxylic acid of one of the three formulae

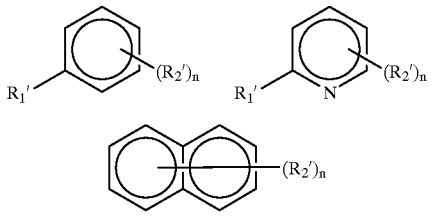

wherein $R_1'$ is —COOH, alkyl, hydroxy, nitro, amino, hydrogen or alkyl derivatives thereof; $R_2'$ is —COOH; and n is an integer from 1 to 4 inclusive when $R_2'$ is —COOH or an integer from 2 to 4 inclusive when $R_1'$ is not —COOH.

e) at least one straight and/or branched chain saturated or unsaturated monocarboxylic acid which is optionally sulphurised in an amount which may be up to 35% by weight; and/or an ester of such an acid; and f) at least one triazole of the formula:

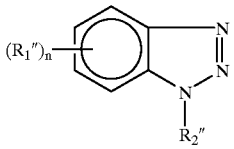

where $R_1''$ is —COOH or alkyl derivatives thereof, or short chain alkyl of up to 5 carbon atoms; n is zero or an integer between 1 and 3 inclusive; and $R_2''$ is hydrogen, morphilino, alkyl, amido, amino, hydroxy or alkyl or aryl substituted derivatives thereof; or a triazole selected from 1,2,4 triazole, 1,2,3 triazole, 5-anilo-1,2,3,4-thiatriazole, 3-amino-1,2,4 triazole, 1-H-benzotriazole-1-yl-methylisocyanide, methylene-bis-benzotriazole and naphthotriazole; and g) at least one phosphorus containing extreme pressure additive.

In component (d) above the bicyclic structural formula is intended to indicate that the group(s) $R_2$ may be attached to either or both aromatic rings.

DETAILED DESCRIPTION OF THE INVENTION

At least one base stock of the base component, is preferably a synthetic ester base stock, especially a polyol ester base stock. The synthetic polyolester which preferably forms a base stock of the lubricating composition of the present invention may be made from $C_5$ to $C_{12}$ monocarboxylic acids esterified with polyols or polyol ethers such as neopentylglycol, dimethylolpropane, trimethylolpropane, pentaerythritol or dipentaerythritol. These are conventional synthetic ester base stocks. Preferred esters are those which are described in U.S. Pat. No. 4,826,633.

The viscosity may be adjusted to lie within the required range by inclusion of one or more viscosity index improvers.

For adequate performance as a transmission lubricant, the base component must have a viscosity in the range of 8.5 to 9.5 cSt, preferably 8.75 to 9.25 cSt, at 100° C. The base component may comprise a single polyol ester but is more usually a mixture of polyol esters, for example, a mixture of a polyol ester having a viscosity of about 4.0 cSt at 100° C. with a polyol ester having a viscosity of about 12.0 cSt at 100° C. Preferred synthetic polyol esters are reaction products of pentaerythritol and/or trimethylolpropane and an acid mixture comprising $C_5$ to $C_{10}$ straight and branched chain acids.

The antioxidant component b) may be a hindered phenolic antioxidant such as butylated hydroxytoluene, suitably present in an amount of 0.01 to 5%, preferably 0.4 to 0.8%, by weight of the lubricant composition. Alternatively, or in addition, component b) may comprise an aromatic amine antioxidant such as mono-octylphenylalphanapthylamine or p,p-dioctyldiphenylamine, used singly or in admixture. The amine anti-oxidant component is suitably present in a range of from 0.01 to 5% by weight of the lubricant composition, more preferably 0.5 to 1.5%.

The neutral organic phosphate which forms component c) of the formulation may be present in an amount of 0.01 to 4%, preferably 1.5 to 2.5% by weight of the composition. The neutral organic phosphate is also a conventional ingredient of lubricating compositions and any such neutral organic phosphate falling within the formula as previously defined may be employed. Tri-cresyl phosphate is a preferred phosphate for use in the present invention.

Components d), e) and f) are intended to provide a corrosion inhibiting three component system. The combination has been found to enable the provision of lubricant compositions capable of passing United States Navy corrosion inhibition requirements (Ball Corrosion Test—ARP 4249) in which a result of 50% non corroded specimen is deemed a satisfactory corrosion protection requirement.

The dicarboxylic acid forming the first component of the anti-corrosion combination may be any dicarboxylic acid falling within the definition given hereinbefore. The dicarboxylic acid may be present in a proportion of up to 0.15% by weight of the composition. It should be noted however, that it is desirable that sebacic acid or an equivalent thereof should always be present in the composition even if another dicarboxylic acid falling within the above definition is present because sebacic acid or an equivalent of it may be necessary to meet parts of the specification other than the ball corrosion test, for example, for satisfactory lead corrosion resistance.

Examples of dibasic acids, other than sebacic acids, which may be used in the present invention, are adipic acid, azelaic acid, dodecanedioic acid, 3-methyladipic acid, 3-nitrophthalic acid, 1,10-decanedicarboxylic acid, and fumaric acid.

The second component of the anti-corrosion combination is a straight or branch-chained, saturated or unsaturated monocarboxylic acid or ester thereof which may optionally be sulphurised in an amount up to 35% by weight. Preferably the acid is a $C_4$ to $C_{22}$ straight chain unsaturated monocarboxylic acid. The preferred concentration of this additive is from 0.001% to 0.35% by weight of the total lubricant composition. The preferred monocarboxylic acid is sulphurised oleic acid. However, other suitable materials are oleic acid itself; valeric acid and erucic acid.

The third component of the anti-corrosion combination is a triazole as previously defined. The triazole should be used at a concentration from 0.005% to 0.25% by weight of the total composition. The preferred triazole is benzotriazole.

Component g) of the composition comprises at least one phosphorus containing extreme pressure additive. Examples of such additives are amine phosphate extreme pressure additives such as that known under the trade name IRGALUBE 349 and/or triphenyl phosphorothionate extreme pressure/anti-wear additives such as that known under the trade name IRGALUBE TPPT. Such amine phosphates are suitably present in an amount of from 0.01 to 2%, preferably 0.2 to 0.6% by weight of the lubricant composition while such phosphorothionates are suitably present in an amount of from 0.01 to 3%, preferably 0.5 to 1.5% by weight of the lubricant composition. Preferably, a mixture of an amine phosphate and phosphorothionate is employed.

For the provision of a helicopter transmission lubricant the amounts of the additive are selected so as to comply with the United States Navy requirement for the Ryder gear test, conducted at 100° C., (average of 6 runs) of 200 (relative rating, % Herco A as reference fluid).

The following example is intended to illustrate a preferred lubricant composition in accordance with the invention.

| | % by weight |
|---|---|
| mono-octylphenylalphanaphthylamine | 0.5% |
| butylated hydroxy toluene | 0.5% |
| benzotriazole | 0.1% |
| sulphurised oleic acid | 0.05% |
| sebacic acid | 0.01% |
| tri-cresyl phosphate | 2.0% |
| amine phosphate | 0.4% |
| triphenyl phosphorothionate | 1.0% |
| silicone antifoam agent | 2 ppm |
| base synthetic ester fluid mixture to give a viscosity for the composition of 8.75 to 9.25 cSt | 95.44% |

The resulting composition was found to give a value of 204.7 in the Ryder gear test, 100° C. (as relative rating, % Herco A) and pass rating in the Ball Corrosion Test (in accordance with ARP method 4249).

What is claimed is:

1. A helicopter transmission lubricant composition formed by combining components comprising:

a) a base component comprising one or more synthetic base stocks, which base component has a viscosity in the range of from 8.5 to 9.5 cSt at 100° C.;

b) at least one antioxidant selected from aromatic amines and hindered phenolics;

c) at least one neutral organic phosphate of the formula $(R^1O)_3PO$ where $R^1$ is a tolyl, phenyl, xylyl, alkyl or cycloalkyl group, the alkyl or cycloalkyl group having up to 10 carbon atoms;

d) at least one saturated and/or unsaturated dicarboxylic acid of the general formula

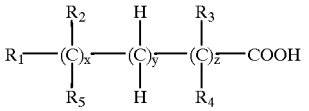

wherein x+y+z is an integer in the range from 2 to 22 inclusive and where at least one of the groups $R_1$ to $R_5$ is a carboxylic acid group and the remaining groups $R_1$ to $R_5$ are selected from alkyl, hydroxy, nitro, amino, carboxyl, hydrogen or alkyl derivatives thereof, where alkyl is a short chain of up to 5 carbon atoms; and/or a dicarboxylic acid of one of the three formulae

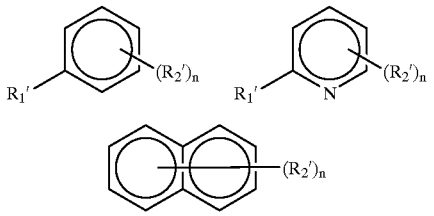

wherein $R_1'$ is —COOH, alkyl, hydroxy, nitro, amino, hydrogen or alkyl derivatives thereof; $R_2'$ is —COOH; and n is an integer from 1 to 4 inclusive when $R_1'$ is —COOH or an integer from 2 to 4 inclusive when $R_1'$ is not —COOH;

e) at least one straight and/or branched chain saturated or unsaturated monocarboxylic acid which is optionally sulphurised in an amount which may be up to 35% by weight; and/or an ester of such an acid; and f) at least one triazole of the formula:

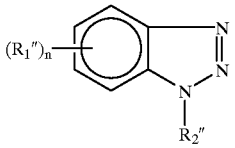

where $R_1''$ is —COOH or alkyl derivatives thereof, or short chain alkyl of up to 5 carbon atoms; n is zero or an integer between 1 and 3 inclusive; and $R_2''$ is hydrogen, morphilino, alkyl, amido, amino, hydroxy or alkyl or aryl substituted derivatives thereof; or a triazole selected from 1,2,4 triazole, 1,2,3 triazole, 5-anilo-1,2,3, 4-thiatriazole, 3-amino-1,2,4 triazole, 1-H-benzotriazole-1-yl-methylisocyanide, methylene-bis-benzotriazole and naphthotriazole; and g) an extreme pressure additive component comprised of a mixture of an amine phosphate in an amount of from 0.2 to 0.6% by weight of the lubricant composition and a phosphorothionate in an amount of from 0.5 to 1.5% by weight of the lubricant composition, said components being combined in amounts such that the composition achieves a score of at least 200% in the Ryder gear test at 100° C.

2. A lubricant composition according to claim 1 wherein at least one base stock of the base component is a polyol ester.

3. A lubricant composition according to claim 1 wherein the base component has a viscosity in the range of from 8.75 to 9.25 cSt at 100° C.

4. A lubricant composition according to claim 1 wherein the antioxidant comprises a hindered phenolic antioxidant present in an amount of 0.4 to 0.8% by weight of the composition.

5. A lubricant composition according to claim 1 wherein the antioxidant comprises an aromatic amine antioxidant present in an amount of 0.5 to 1.5% by weight of the composition.

6. A lubricant composition according to claim 1 wherein the neutral organic phosphate is present in an amount of 1.5 to 2.5% by weight of the composition.

7. A lubricant composition according to claim 1 wherein the saturated and/or unsaturated dicarboxylic acid component (d) is present in an amount of up to 0.15% by weight of the composition.

8. A lubricant composition according to claim 1 wherein the saturated and/or unsaturated dicarboxylic acid component (d) comprises sebacic acid.

9. A lubricant composition according to claim 1 wherein the monocarboxylic and component (e) is present in an amount of from 0.001 to 0.35% by weight of the composition.

10. A lubricant composition according to claim 1 wherein the monocarboxylic acid component (e) comprises sulphurised oleic acid.

11. A lubricant composition according to claim 1 wherein the triazole component (f) is present in an amount of from 0.005 to 0.25% by weight of the composition.

12. A lubricant composition according to claim 1 wherein the triazole component (f) comprises benzotriazole.

13. A lubricant composition according to claim 2 wherein the polyol ester base stock comprises one or more $C_5$ to $C_{12}$ monocarboxylic acids esterified with one or more polyols or polyol ethers.

* * * * *